United States Patent [19]

Mallaghan

[11] Patent Number: 4,879,023

[45] Date of Patent: Nov. 7, 1989

[54] CONVEYOR ASSEMBLY

[75] Inventor: Michael L. Mallaghan, Dungannon, United Kingdom

[73] Assignee: Powerscreen International Limited, County Tyrone, United Kingdom

[21] Appl. No.: 245,970

[22] Filed: Sep. 16, 1988

Related U.S. Application Data

[63] Continuation of Ser. No. 115,573, Oct. 7, 1987, abandoned, which is a continuation of Ser. No. 867,225, May 27, 1986, abandoned.

[30] Foreign Application Priority Data

May 28, 1985 [GB] United Kingdom ..... 8513428

[51] Int. Cl.[4] ..... B07B 1/00

[52] U.S. Cl. ..... 209/241; 209/420

[58] Field of Search ..... 209/240, 241, 243, 247, 209/255, 257, 352–355, 420, 421, 935; 198/311, 313, 314

[56] References Cited

U.S. PATENT DOCUMENTS

| | | | |
|---|---|---|---|
| 1,661,781 | 3/1928 | Whitnall | 209/247 |
| 1,840,029 | 1/1932 | Garbe | 209/247 X |
| 1,846,668 | 2/1932 | Barber | 209/241 |
| 2,022,146 | 11/1935 | Ossing | 209/247 UX |
| 2,922,510 | 1/1960 | Zetterlund | 209/241 X |
| 4,058,198 | 11/1977 | O'Neill et al. | 198/314 X |
| 4,190,526 | 2/1980 | Bachand | 209/421 X |
| 4,303,506 | 12/1981 | Finlay | 209/421 X |
| 4,591,432 | 5/1986 | Hartl | 209/421 X |

FOREIGN PATENT DOCUMENTS

| | | | |
|---|---|---|---|
| 0093576 | 11/1983 | European Pat. Off. . | |
| 3105086 | 8/1982 | Fed. Rep. of Germany . | |
| 1345485 | 1/1963 | France | 209/421 |
| 2332682 | 6/1977 | France | 209/421 |
| 1414786 | 11/1975 | United Kingdom | 198/314 |
| 1546085 | 5/1979 | United Kingdom . | |
| 1553667 | 10/1979 | United Kingdom . | |
| 2034606 | 6/1980 | United Kingdom . | |
| 2100692 | 1/1983 | United Kingdom | 198/311 |

OTHER PUBLICATIONS

European Search Report.

*Primary Examiner*—Johnny D. Cherry
*Assistant Examiner*—Edward M. Wacyra
*Attorney, Agent, or Firm*—Dickstein, Shapiro & Morin

[57] ABSTRACT

A conveyor assembly comprising a main inclined conveyor with a screen box located at a discharge or off-loading end thereof, the main conveyor and screen box being located on an elongate structure including length adjustable legs intermediate its ends mounted on wheels. The loading end of the screen box is pivoted on an axis transversely of and at the discharge end of the structure with the screen box extending towards the loading end of the structure, the discharge end of the screen box being connected to the structure by length-adjustable legs thereby to alter the inclination of the box. A cradle is suspended below the structure to carry one or more boom conveyors the or each to receive a grade of material, the cradle being horizontally oriented and connected by linkage with the structure and the box whereby pivotal movement of the box causes synchronous movement of the cradle such as to maintain a horizontal orientation of the cradle.

3 Claims, 2 Drawing Sheets

CONVEYOR ASSEMBLY

Figure 1:
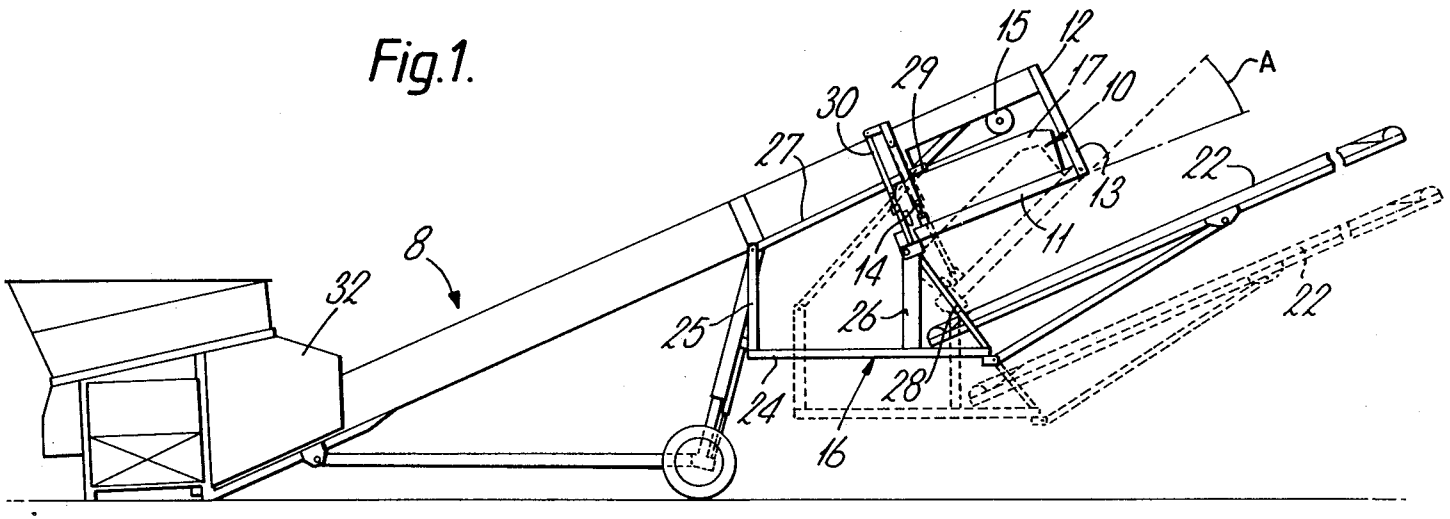

This application is a continuation of Ser. No. 115,573 filed Oct. 7, 1987 which is a continuation of Ser. No. 867,225 filed May 27, 1986, both now abandoned.

This invention relates to a conveyor assembly having a main inclined conveyor and a screening apparatus at a discharge or off-loading end thereof. The main conveyor includes an elongate support structure carried intermediate its ends by length-adjustable legs (extendible or retractable by a hydraulic ram) whose roots are carried on an axle transverse of said support structure, said axle having at each end a ground-engaging wheel. An endless belt conveyor is entrained around two rollers mounted on and spaced lengthwise of said support structure, the upper flight of the belt being pulled over a series of spaced low-friction idling roller units to concave said upper flight such to enable material to be carried thereup. The screening apparatus has a screen box usually inclined and normally of a rectangular fabrication in both horizontal and vertical cross-sections having, with an open end outlet, a wall surround defining an open area masked by one or more reticular and/or non-reticular screens thereby to give, when material is passed thereinto, two or more grades of said material. In use of said conveyor assembly, material fed up the conveyor belt is discharged into the screen box, is graded and falls therefrom into two or more grades depending on the number of screens fitted thereto, partition means to separate said grades have been used and with greater throughput of material, additional conveyors have been provided to convey the different grades of material away from the apparatus. One of these additional conveyors can be mounted on said main conveyor and the others, if any, or all can be separate pieces of conveyor equipment. These conveyors serve particularly to prevent the graded materials admixing again due to close proximity of the piles of graded material and to ensure that the conveyor assembly does not require to be resited after short periods. To increase the number of grades of material and prevent admixing, and to obviate the necessity of requiring separate pieces of conveyor equipment is an object of the present invention.

According to the present invention, there is provided a conveyor assembly comprising a main inclined conveyor with a screen box located at a discharge or off-loading end thereof, said main conveyor and screen box being located on an elongate structure including length adjustable legs intermediate its ends mounted on wheels, in which the loading end of the screen box is pivoted transversely of and at the discharge end of the structure with the screen box extending towards the loading end of the structure, the discharge end of the screen box being connected to said structure by length-adjustable means thereby to alter the inclination of said box, and a cradle is suspended below said structure to carry one or more boom conveyors the or each to receive a grade of material, said cradle being horizontally oriented and connected by linkage with said structure and said box whereby pivotal movement of said box causes synchronous movement of the cradle such to maintain a horizontal orientation of said cradle.

Preferably, two lateral boom conveyors are mounted on said cradle to extend in opposite directions therefrom. A third boom conveyor preferably extends from said cradle to beyond the discharge end of the main conveyor.

Preferably further, separate funnel means are provided to receive each grade of material and convey it to a loading end of a respective boom conveyor.

Figure 2:
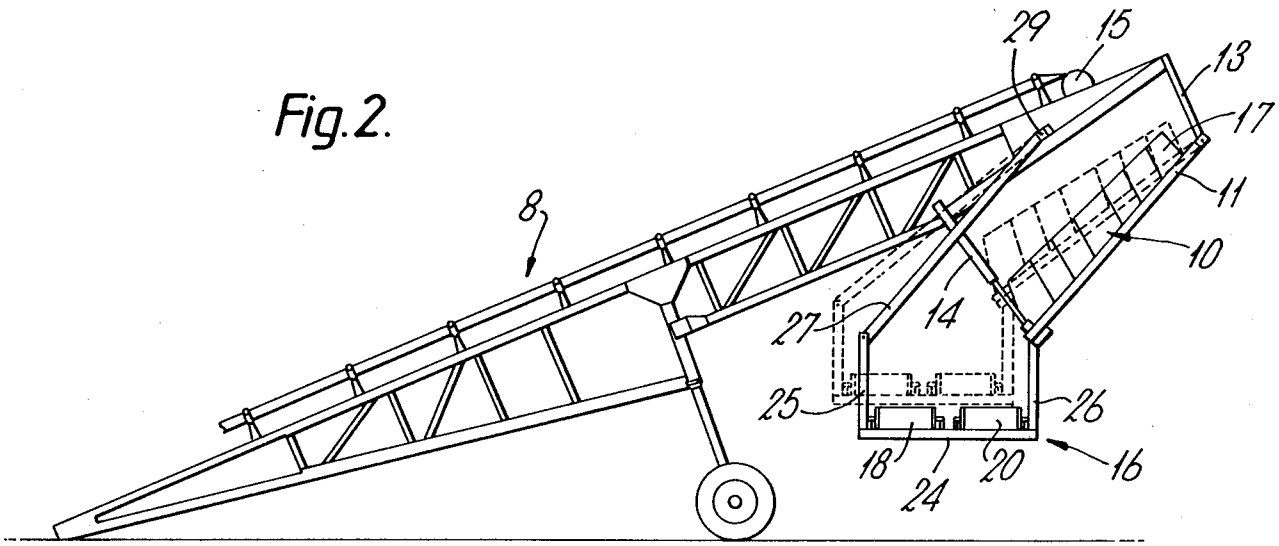

An embodiment of the present invention will now be described, by way of example, with reference to the accompanying drawings, in which:

FIG. 1 is a side elevation of a conveyor assembly according to the present invention, in which a stowed or out-of-use position to a screen box is shown in full line and an in-use position is shown in broken line, two lateral boom conveyors being omitted for clarity; and FIG. 2 is a side elevation of a conveyor assembly in which two lateral boom conveyors only are provided.

Referring to the drawings, a conveyor assembly 8 of the type stated has its screen box 10 hinged at one end along an axis transverse of the longitudinal axis of the structure 12 at the discharge end of said structure 12. As shown in the drawings, an arm 13 depends from each side of the structure 12 beyond the belt roller 15 and a frame 11 carrying the wall surround 17 of the box is hinged to the lower ends thereof. The screen box 10 has two screens and extends towards the loading end of the structure. Length-adjustable means connects the discharge or open outlet end of the screen box to the structure thereby to alter the inclination of said box 10 relative to said structure. The means is formed by a ram and cylinder arrangement 14. A cradle 16 is suspended below said structure 12 to carry one or more boom conveyors, in this embodiment three boom conveyors comprising two lateral boom conveyors 18, 20 mounted to extend in opposite directions therefrom and a longitudinal boom conveyor 22 mounted to extend beyond the discharge end of the conveyor belt. The cradle 16 has a rectangular mounting platform 24 carried at each side by an upstand 26 whose upper end is pivoted to the frame 11 at the discharge end of the box. The platform 24 extends beyond the upstand 26 and at its outer end is connected at each side by a stay 28 to said upstand 26 adjacent or near to its upper pivoted pisition. The opposite end of the platform extension is carried on each side by two pivoted arms 25, 27, arms 25 being secured to the platform 24 and arms 27 being pivoted, one on each side of the structure 12, at a first point 29. Hanger arms 30 are provided, one on each side, as shown in FIG. 1 and are length adjustable being in two parts one telescoping into the other. The other part having one set of an opposed pair of aligned holes, and the one part having a series of sets of lengthwise spaced opposed pairs of aligned holes such that when any one set of holes on the one part is aligned with the set of holes on the other part, they can be locked together by a pin passing therethrough. The hanger arms 30 also serve as stabilisers against sideways movement of the cradle 16.

Separate funnel or chute means are provided one to receive each grade of material, i.e. three grades from the two screens. A first grade is the rejected material from the upper screen, a second grade is the rejected material of the lower screen and the third grade is the material passing through both screens. Each of the three funnel or chute means conveys the respective grade to a feed boot located at the loading end of its respective boom conveyor.

FIGS. 1 and 2 differ as regards the construction of the conveyor assembly and in the particular mounting of the screen box and cradle relative to the structure. FIG. 2 does not show a platform extension for a discharge end boom conveyor 22 nor hanger arms 30. A feed hopper 32 can be provided at the loading end of the conveyor assembly 8 as shown in FIG. 1 (omitted in FIG. 2).

In use, and as shown in FIG. 1 the screen box 10 can be inclined through an angle "A". By unlocking hanger arms 30 from the out-of-use or stowed position shown in full line in FIG. 1, the arrangements 14 can be extended to the desired in-use angle of inclination within "A" at which the hanger arms are relocked.

Movement of the box 10 causes corresponding movement of the cradle 16 through its linkages with the box 10 and structure 12. Boom conveyors 18, 20 require to be removed for transport to and from a quarry or like location where grading of material is required to be conducted.

I claim:

1. A conveyor assembly comprising a main inclined conveyor having a loading end and a discharge end with a screen box having a loading end and a discharge end located at the discharge end of the conveyor, said main conveyor and screen box being located on an elongated structure having a loading end and a discharge end including length adjustable legs intermediate its ends mounted on wheels, in which the loading end of the screen box is pivoted about an axis traversely of and at the discharge end of the structure with the discharge end of the screen box extending towards the loading end of the structure, the discharge end of the screen box being connected to said structure by length adjustable means thereby to alter the inclination of said box, and a cradle is suspended below said structure to carry at least one boom conveyor to receive a grade of material, said cradle being horizontally oriented and connected by linkage with said structure and said box whereby pivotal movement of said box causes synchronous movement of the cradle such as to maintain a horizontal orientation of said cradle, and wherein said at least one boom conveyor comprises two lateral boom conveyors mounted on said cradle to extend in opposite directions therefrom.

2. A conveyor assembly comprising a main inclined conveyor having a loading end and a discharge end with a screen box having a load end and a discharge end located at the discharge end of the conveyor, said main conveyor and screen box located on an elongated structure having a loading end and a discharge end including length adjustable legs intermediate its ends mounted on wheels, in which the loading end of the screen box is pivoted about an axis traversely of and at the discharge end of the structure with the discharge end of the screen box extending towards the loading end of the structure, the discharge end of the screen box being connected to said structure by length adjustable means thereby to alter the inclination of said box, and a cradle is suspended below said structure to carry at least one boom conveyor to receive a grade of material, said cradle being horizontally oriented and connected by linkage with said structure and said box whereby pivotal movement of said box causes synchronous movement of the cradle such as to maintain a horizontal orientation of said cradle, and wherein said at least one boom conveyor comprises two lateral boom conveyors mounted on said cradle to extend in opposite directions therefrom and a third boom conveyor extending from said cradle to beyond the discharge end of the main conveyor.

3. A conveyor assembly comprising a main inclined conveyor having a loading end and a discharge end with a screen box having a loading end and a discharge end located at the discharge end of the conveyor, said main conveyor and screen box being located on an elongated structure having a loading end and a discharge end including length adjustable legs intermediate its ends mounted on wheels, in which the loading end of the screen box is pivoted about an axis traversely of and at the discharge end of the structure with the discharge end of the screen box extending towards the loading end of the structure, the discharge end of the screen box being connected to said structure by length adjustable means thereby to alter the inclination of said box, and a cradle is suspended below said structure to carry at least one boom conveyor to receive a grade of material, said cradle being horizontally oriented and connected by linkage with said structure and said box whereby pivotal movement of said box causes synchronous movement of the cradle such as to maintain a horizontal orientation of said cradle, and wherein said at least one boom conveyor comprises two lateral boom conveyors mounted on said cradle to extend in opposite directions therefrom and a third boom conveyor extending from said cradle to beyond the discharge end of the main conveyor and including separate funnel means arranged to receive and direct each grade of material to a loading end of a respective boom conveyor.

* * * * *